United States Patent [19]

Moeller

[11] Patent Number: 4,961,505

[45] Date of Patent: Oct. 9, 1990

[54] ROD HOLDER

[75] Inventor: David E. Moeller, Bainbridge Island, Wash.

[73] Assignee: Loomis Plastics Incorporated, Seattle, Wash.

[21] Appl. No.: 464,547

[22] Filed: Jan. 16, 1990

[51] Int. Cl.[5] ..... A47F 7/00

[52] U.S. Cl. ..... 211/70.8; 211/65; 211/69; 211/69.8; 211/94; 248/316.7

[58] Field of Search ..... 211/70.8, 65, 68, 69, 211/69.8, 94; 248/316.7

[56] References Cited

U.S. PATENT DOCUMENTS

| | | | |
|---|---|---|---|
| 1,643,661 | 9/1927 | Kendall | 211/65 |
| 2,438,989 | 4/1948 | Billman | 211/69 |
| 3,291,427 | 12/1966 | Hutchings | 211/70.8 |
| 3,421,632 | 1/1969 | Wood | 211/70.8 |
| 3,487,947 | 1/1970 | Bogard | 211/70.8 |
| 3,876,076 | 4/1975 | Hazelhurt | 211/70.8 |
| 4,014,466 | 3/1977 | Wess | 211/70.8 |
| 4,109,796 | 8/1978 | Mitchell | 211/70.8 |
| 4,182,455 | 1/1980 | Furawin | 211/69.8 |
| 4,582,203 | 4/1986 | Davis | 211/70.8 |
| 4,807,381 | 2/1989 | Southard | 211/64 |

*Primary Examiner*—Reinaldo P. Machado
*Attorney, Agent, or Firm*—Christopher Duffy

[57] ABSTRACT

The bracket 6 of the rod holder 2 is constructed of substantially resiliently flexible material and has four slots 24, 26, 28 and 30 in the rim 18 thereof, which depend to points 37 substantially contiguous to the base plate 4, so that the bracket is divided into pairs of relatively resiliently displaceable body portions 38, 40, 42, 44, and 46. The walls 36 of the body portions have successive pairs of part annular collar sections 34 therein, which define successively smaller clamping rings 48, with nips 50 therebetween, as the slots depend toward the plate 4. As a result, when a rod 96 is impaled in the V-shaped kerf of a slot, it can seek that ring 48 which will grip it against dislodgement, when the caduceus-like clamps 32 at the walls of the body portions, relax about the rod.

12 Claims, 3 Drawing Sheets

Fig. 1
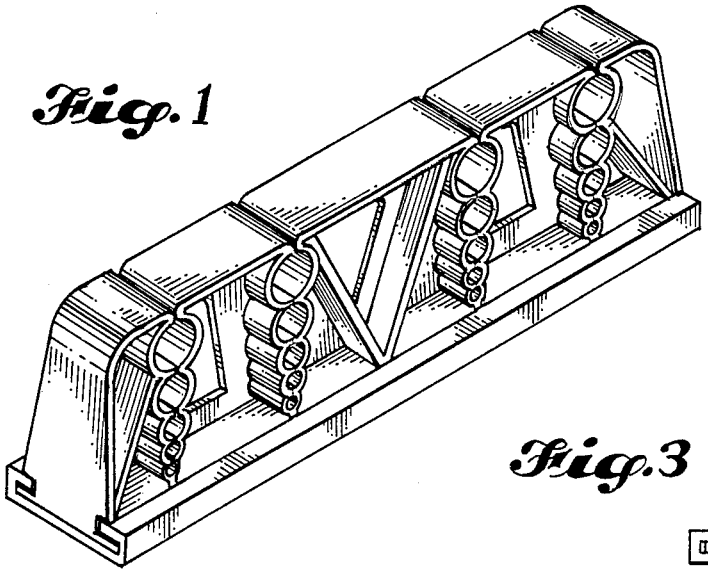
Fig. 3
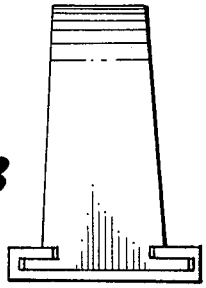
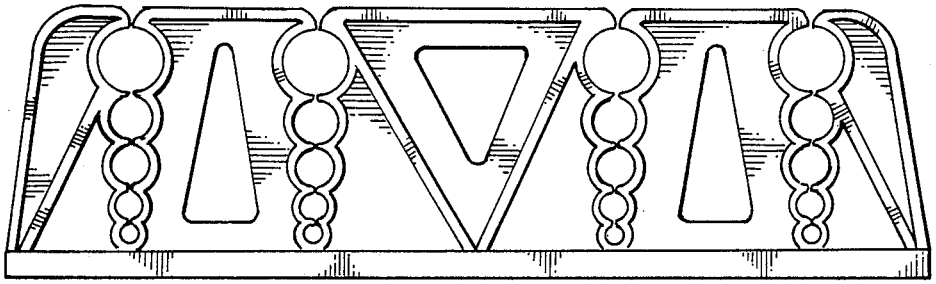
Fig. 2
Fig. 4
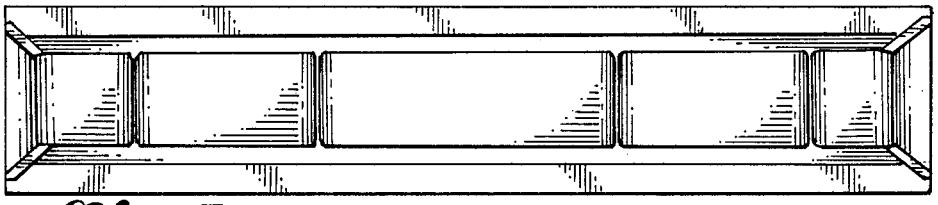
Fig. 5
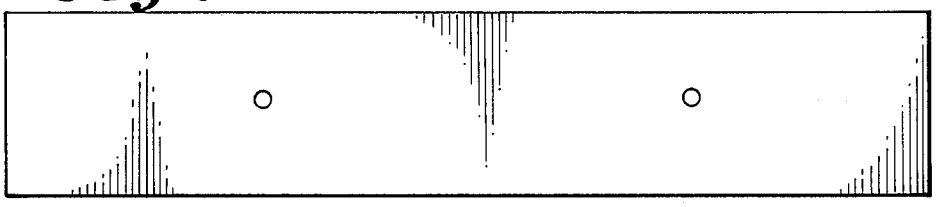

Fig. 8
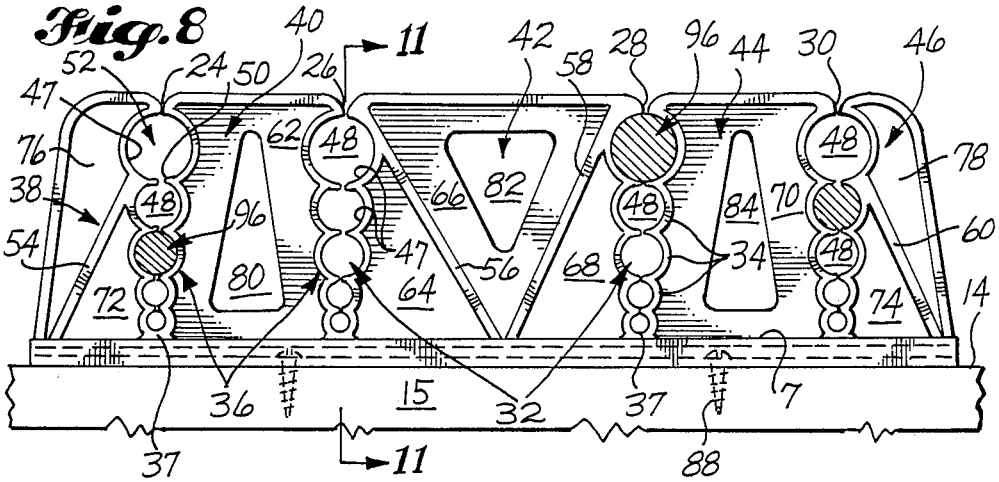
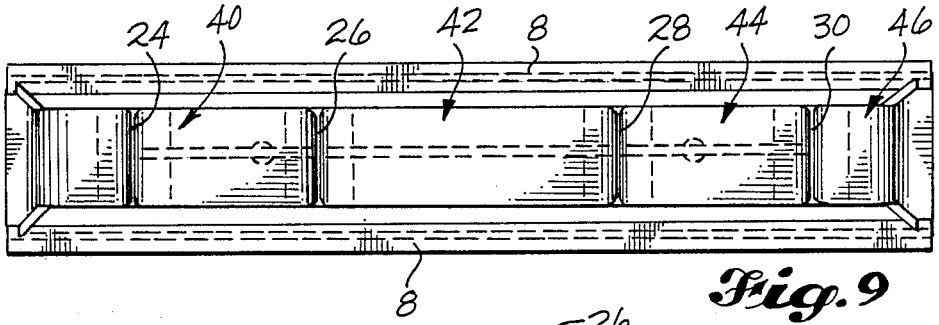
Fig. 9
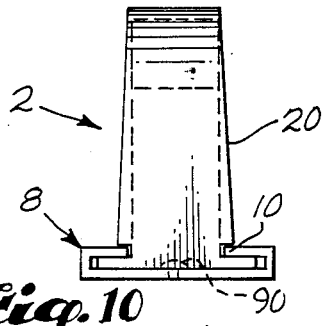
Fig. 10
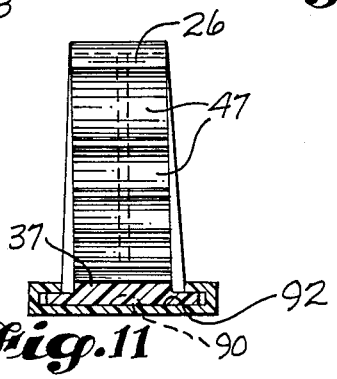
Fig. 11
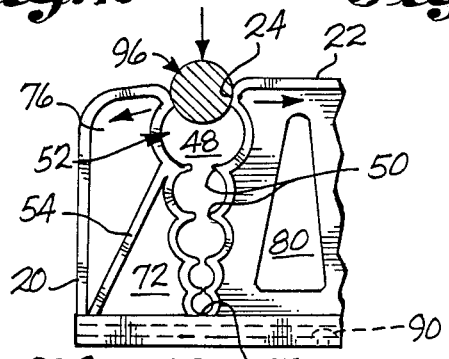
Fig. 12

ROD HOLDER

TECHNICAL FIELD

This invention relates to a holder for fishing rods, golf clubs, baseball bats, billiard cues, boat oars, brooms and other rods which a seller or user may wish to mount off the floor, such as at a site in the cabin of the user's boat, his house, his garage or wherever such rods are stored. In particular, the invention relates to a rod holder which is universal in its functional capability in that it can be used alone or as a pair, it can be used for all sizes of rods, it can be used for mounting the rods in the vertical, or in the horizontal, or even at a cant, it can be used with a relatively hard or a relatively soft rod, it can be mounted on a flat or rounded surface of the substrate to which it is attached, and it can be used with a separate mounting plate, if desired, and moreover, removed from the same for cleaning when desired. It also enables the rod to be raised off the floor, yet it is impact resistant, and it assures that the rod will not be jarred free by the vibration or other activity of the substrate, such as in the case of a substrate on a boat or other moving vehicle. And perhaps, most important, it can be molded or otherwise formed as a monolithic structure, using common plastic or other resiliently flexible materials.

BACKGROUND ART

Great numbers of rod holders have been disclosed in the past, but no one of them has had such universal functional capability. Commonly they were needed in pairs, or they were needed in different sizes for different size rods, or they were capable of being used only in the vertical, or in the horizontal, but not in both, or they could be used only with a hard rod or a soft rod, but not both, or they required a flat surface on the substrate to which they were attached, or they required that the rod be supported on the floor, or they were subject to the rod being jarred loose by vibration or other activity on the part of the substrate.

DISCLOSURE OF THE INVENTION

This universal functional capability and certain other related objects and advantages, are achieved by a rod holder of my invention which comprises a base plate, and a bracket of substantially resiliently flexible material, which is relatively upstanding on the base plate at one side thereof. The bracket has a rimmed infrastructure lying between opposing sides thereof, and a slot in the rim thereof, which opens to the sides of the infrastructure. The slot has a center plane perpendicular to the one side of the plate, and walls which depend from the rim to a point substantially contiguous to the one side of the plate, so that the body of the bracket is divided into two relatively resiliently displaceable portions having opposing walls on the opposing sides of the plane of the slot. The walls of the body portions have successive pairs of part annular collar sections therein, the recesses of which are opposed to one another across the plane of the slot and define successive clamping rings, the diameters of which, in the normally relaxed condition of the bracket, are progressively smaller in the planar direction of the slot relatively toward the one side of the plate, so that the body portions of the bracket form a caduceus-like pair of clamps which are relatively reciprocable about said point, and have a nip between each pair of clamping rings at the plane of the slot.

Meanwhile, in addition to the plate and the bracket, the rod holder also comprises prop means in the body portions of the bracket for yieldably shoring-up the pair of clamps. The prop means are operable to bias the clamps in the direction of closing the nips, but are yieldable in the opposing direction to the planar impalement of a rod in the slot at the rim of the infrastructure, and to depression of the rod through each successive nip thereafter, until a particular clamping ring has a diameter sufficiently commensurate with that of the rod to assure that the bracket will retain the rod against movement in the plane of the slot, when the rod is released in the bracket and the bracket resumes the normal relaxed condition thereof.

The rod holder has many variations, but in certain of the presently preferred embodiments of the invention, the collar sections and the rim of the infrastructure have a substantially common width on perpendiculars to the sides of the infrastructure, and the body portions of the bracket also form a nip at the opening of the slot in the rim of the infrastructure. Moreover, in some of these embodiments, the recesses are part cylindrical, so that each pair of clamping sections forms a substantially cylindrical surface when the nips are closed under the bias of the prop means.

In some embodiments, the prop means include a strut that is obliquely inclined to one of the clamps in the infrastructure of the adjoining body portion of the bracket. For example, where the collar sections and the rim of the infrastructure have a substantially common width on perpendiculars to the sides of the infrastructure, the one clamp may be spaced apart from one end of the base plate, one end portion of the rim may incline from the level of the opening of the slot, to the level of the one end portion of the base plate, and the strut may be interposed between the one end portion of the rim and the one clamp, in the space between the one clamp and the one end of the base plate. In addition, the infrastructure of the respective body portion may be open from side-to-side thereof, in the space between the strut and the one clamp, as well as in the space between the strut and the one end portion of the rim.

In other embodiments of the invention, the prop means include an open-faced web that is perpendicular to one of the clamps in the infrastructure of the adjoining body portion of the bracket. If a single web is used, it is commonly disposed in a plane central of and parallel to the opposing sides of the infrastructure. Moreover, where the collar sections and the rim of the infrastructure have a substantially common width on perpendiculars to the sides of the infrastructure, the rim may extend at the level of the opening of the slot, to the opening of a second slot spaced apart from the one clamp on the rim of the infrastructure, and the web may be interposed between the rim and the base plate in the space between the one clamp and the second slot.

Commonly, the bracket has a plurality of spaced slots in the rim thereof which open to the sides of the infrastructure. Furthermore, the slots all have center planes which are perpendicular to the one side of the plate, and walls which depend from the rim to points substantially contiguous to the one side of the plate, so that the body of the bracket is divided into pairs of relatively resiliently displaceable portions having opposing walls on the opposing sides of the planes of the slots. Moreover, the walls of the respective pairs of body portions have successive pairs of part annular collar sections therein, the recesses of which are opposed to one another across the respective planes of the slots and define successive clamping rings, the diameters of which, in the normally relaxed condition of the bracket, are progressively smaller in the planar directions of the slots relatively toward the one side of the plate, so that the respective pairs of body portions form caduceus-like pairs of clamps which are relatively reciprocable about said points, and have nips between the respective pairs of clamping rings at the respective planes of the slots. Meanwhile, the prop means in the respective pairs of body portions, are operable to bias the respective pairs of clamps in the direction of closing the nips of the respective slots, but are yieldable in the opposing direction to the planar impalement of a rod in any one of the slots at the rim of the infrastructure, and to depression of the rod through each successive nip thereafter in the respective slot, until a particular clamping ring has a diameter sufficiently commensurate with that of the rod to assure that the bracket will retain the rod against movement in the plane of the slot, when the rod is released in the bracket and the bracket resumes the normally relaxed condition thereof.

In some embodiments, for example, the bracket is trapezoidal at the opposing sides thereof, and the infrastructure of the bracket has four slots in the rim thereof, and alternate struts and webs in the successive body portions thereof, from one inclined end portion of the rim to the other.

In one group of embodiments, the invention also lends itself to an ornamental design, as shall be described.

BRIEF DESCRIPTION OF THE DRAWINGS

These features will be better understood by reference to the accompanying drawings which illustrate a presently preferred embodiment of the invention, including the new design, when the holder is employed as a pair of the same to support a fishing rod or the like.

In the drawings:

FIG. 1 is a perspective view of one holder, showing the overall design thereof;

FIG. 2 is a side elevational view of the design of the holder, the side opposite being a mirror image of the same;

FIG. 3 is an end elevational view of the design of the holder, the end opposite being a mirror image of the same;

FIG. 4 is a top plan view of the design of the holder;

FIG. 5 is a bottom plan view of the design of the holder;

FIG. 8 is a side, elevational view of the one holder when in use;

FIG. 9 is a top plan view of the one holder;

FIG. 10 is an end elevational view of the one holder;

FIG. 11 is a cross sectional view of the one holder along the line 11—11 of FIG. 8; and FIG. 12 is a part side elevational view of the one holder when a rod is impaled in one of the slots of the same.

BEST MODE FOR CARRYING OUT THE INVENTION

Figure 6:
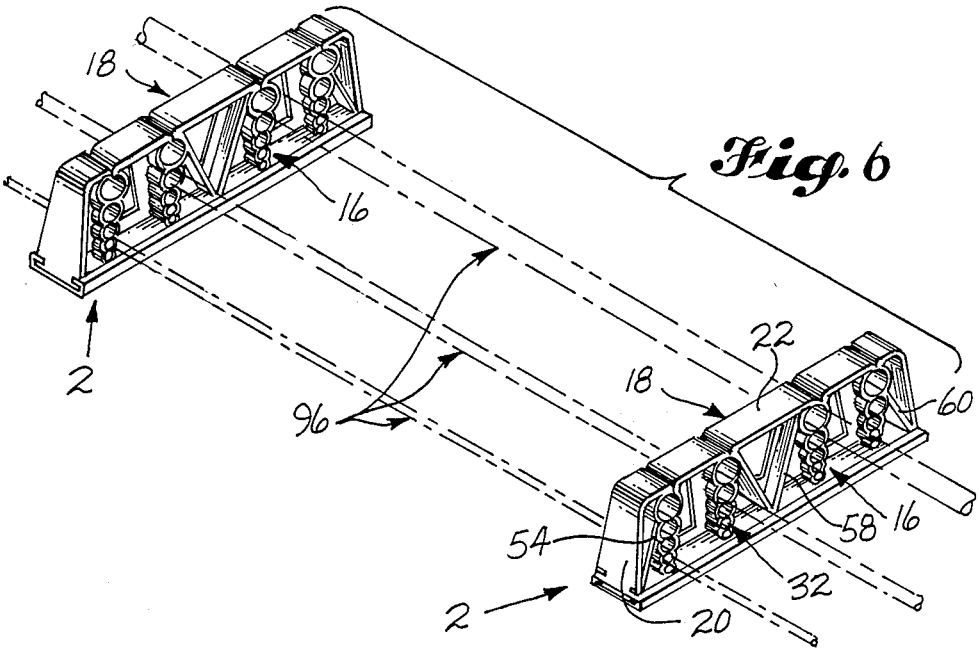
FIG. 6 is a perspective view of the pair of holders when in use.
Figure 7:
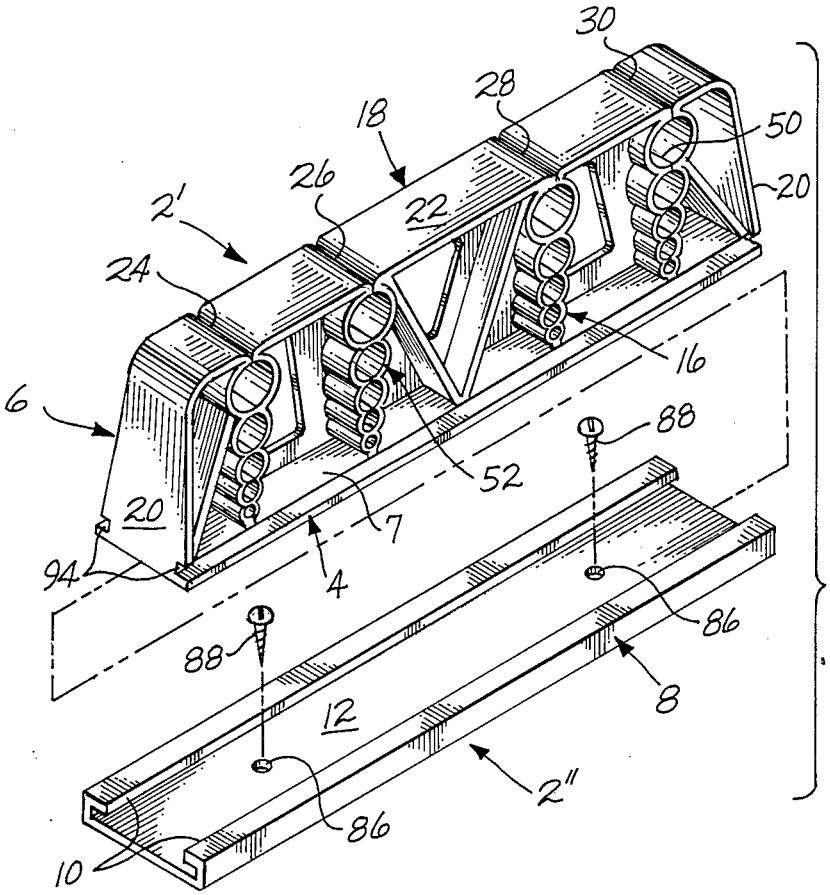
FIG. 7 is an exploded perspective view of one of the pair of holders.

Referring to the drawings, it will be seen that each holder 2 is in two parts, one of which, 2', is the operative portion of the holder, and the other of which, 2', provides a mounting plate for the same. The operative portion 2' comprises an elongated rectangular base plate 4, and a bracket 6 of substantially resiliently flexible material, relatively upstanding on the plate at one side 7 thereof. The mounting plate 2' takes the form of a channeled rail 8, the inturned flanges 10 of which form an open-topped sheath 12 within which the base plate 4 of the bracket 6 can be slideably inserted after the rail has been mounted on the surface 14 of a substrate 15, as shall be explained. When so assembled, the bracket 6 upstands from the surface, and though commonly paired with another such bracket 6, as shown, the bracket can be used as the sole means for supporting a rod 96, as shall be explained.

The bracket 6 has a rimmed infrastructure 16 lying between the opposing laterally oriented sides thereof, and in this instance, the rim 18 of the infrastructure has a band-like character, the band 18 being the full width of the base plate 4 at the bottoms of its ends 20, but trapezoidal at the ends 20 themselves, as well as in profile at the opposing sides of the infrastructure 16. The band 18 is also rounded at the corners, and cleaved at the top 22 in spaced parallel planes that are perpendicular to the base plate, and to the sides of the infrastructure. The slits form the openings of slots 24, 26, 28, and 30 which open to the sides of the infrastructure, and the center planes of which are perpendicular to the one side 7 of the plate 4. Moreover, the walls 36 of the slots depend from the rim 18 to points 37 substantially contiguous to the one side 7 of the plate, so that the body of the bracket 6 is divided into pairs of relatively resiliently displaceable portions 38, 40, 42, 44, and 46 having opposing walls 36 on the opposing sides of the planes of the slots.

Furthermore, the walls 36 of the body portions, i.e., the walls of the slots, have successive pairs of part annular collar sections 34 therein, the recesses 47 of which are opposed to one another across the planes of the slots, and define successive clamping rings 48 in each slot, the diameters of which, in the normally relaxed condition of the bracket, are progressively smaller in the planar directions of the slots relatively toward the one side 7 of the plate. As a consequence, the respective pairs of body portions 38, 40, 42, 44, and 46 form caduceus-like pairs of clamps 32 which are relatively reciprocable about the respective points 37 of the slots, and have nips 50 between the respective pairs of clamping rings 48 at the respective planes of the slots.

The collar sections 34 and the rim 18 of the infrastructure 16 have a substantially common width on perpendiculars to the sides of the infrastructure, and the body portions of the bracket form nips at the openings of the slots 24, 26, 28, 30 in the rim of the infrastructure, in addition to those between the respective pairs of clamping rings 48 at the planes of the respective slots. Consequently, when a rod 96 is impaled in a slot, planar thereof, and then depressed through the generally V-shaped kerf 52 thereof (FIG. 12), in the direction of the point 37, the adjoining pair of body portions must accommodate to the wedging action of the rod, both in the sense of flexing, and in the sense of not collapsing under the crush of the rod, nor torquing in one direction or the other relative to the plane of the slot. Therefore, to accommodate, the body portions have a system of alternate struts 54, 56, 58, 60 and webs 62, 64, 66, 68, 70 in the infrastructure thereof, which are operable to yieldably shore up the respective pairs of clamps 32 in the sense that the clamps are biased in the direction of closing the nips 50, but are yieldable in the opposing direction to the planar impalement of a rod 96 in a slot at the rim 18 of the infrastructure, and to depression of the rod through each successive nip 50 thereafter, until a particular clamping ring 48 has a diameter sufficiently commensurate with that of the rod to assure that the bracket 6 will retain the rod against movement in the plane of the slot, when the rod is released in the bracket and the bracket resumes the normally relaxed condition thereof.

More specifically, the end adjacent clamps of the relatively endmost pairs of clamps 32 are shored up by a pair of struts 54, 60 that are obliquely inclined to the same from the bottoms of the ends 20 of the rim 18. The struts 54, 60 merge with the uppermost collar sections 34 of the clamps, at the bottoms thereof, and provide vectors of vertical support for the clamps, upward of the slots, as well as relatively horizontal vectors of force inward of the slots, tending to yieldably bias the clamps in the direction of closing the nips 50 of the slots. Meanwhile, the areas 72, 74 between the struts 54, 60 and the clamps, are open, as are the areas 76, 78 between the struts and the ends of the rim, so that the overall infrastructure of the bracket at its ends 20, is such that the end-adjacent clamps 32 can flex relatively away from the planes of their slots, in the direction of the ends 20, when rods 96 are introduced to the slots. Similarly, the center adjacent clamps of the intermediate pairs of clamps are shored up by obliquely inclined struts 56, 58 at the center of the bracket, which in this instance, however, merge with the uppermost collar sections 34 of the clamps at the rim 18 of the infrastructure. To stabilize the bracket as a whole, moreover, the area between the struts 56, 58 is occupied by a web 66 having an opening 82 of inverted triangular shape therein. The areas between the struts 56, 58 and the clamps are also occupied by further webs 64, 68, and the three webs are all disposed in the longitudinal center plane of the bracket to add stiffness to the bracket as a whole for handling, yet allow the center adjacent clamps to flex inwardly of the bracket when rods are introduced to the slots thereof.

Meanwhile, the areas between the center adjacent clamps of the endmost pairs of clamps 32, and the end adjacent clamps of the intermediate pairs of clamps, are occupied by still further webs 62, 70, which once again extend in the longitudinal center plane of the bracket and, like the web 66, have triangular openings 80, 84 in the same, which, however, in these instances are upright, rather than inverted. The webs 62, 70 extend in conjunction with the relatively horizontal portions of the rim of the infrastructure, at the top 22 thereof, and together with them, assure that the overall infrastructure of the intermediate portions 40, 44 of the bracket provide, on one hand, vectors of vertical support for the intermediate clamps, upward of the slots, and on the other, relatively horizontal vectors of force inward of the slots, tending to yieldably bias the clamps in the direction of closing the nips 50 of the slots.

When the holder is put to use, the rail 8 is applied to the surface 14 of the substrate 15, and a pair of holes 86 in the rail are used for securing the rail to the same with screws 88 or the like, as shown. Commonly, screws with raised heads are employed, as shown, so that dimples 90 in the underside 92 of the base plate 4 can engage the same to serve as detents with which to releasably secure the plate in the rail. In addition, the ends 20 of the rim 18 have slots 94 in the bottoms thereof to enable the bracket 6 to be slideably engaged in the rail between the flanges 10 of the same, as shown in FIG. 11.

The operative portion 2' of the holder is commonly molded from a semi-rigid, yet resilient polyolefinic or other thermoplastic material having a Shore A scale durometer of about 60–85, providing the necessary flexural strength, flexural modulus, and yet Shore A hardness. In fact, preferably, a material of 68–78 Shore A scale durometer is employed for the purpose.

I claim:

1. In a rod holder, a base plate a bracket of substantially resiliently flexible material, relatively upstanding on the base plate at one side thereof, said bracket having a rimmed infrastructure lying between opposing sides thereof, and a slot in the rim thereof which opens to the sides of the infrastructure, said slot having a center plane perpendicular to the one side of the plate, and walls which depend from the rim to a point substantially contiguous to the one side of the plate, so that the body of the bracket is divided into two relatively resiliently displaceable portions having opposing walls on the opposing sides of the plane of the slot, the walls of the body portions having successive pairs of part annular collar sections therein, the recesses of which are opposed to one another across the plane of the slot and define successive clamping rings, the diameters of which, in the normally relaxed condition of the bracket, are progressively smaller in the planar direction of the slot relatively toward the one side of the plate, so that the body portions of the bracket form a caduceus-like pair of clamps which are relatively reciprocable about said point, and have a nip between each pair of clamping rings at the plane of the slot, and prop means in the body portions of the bracket for yieldably shoring up the pair of clamps, said prop means being operable to bias the clamps in the direction of closing the nips, but yieldable in the opposing direction to the planar impalement of a rod in the slot at the rim of the infrastructure, and to depression of the rod through each successive nip thereafter, until a particular clamping ring has a diameter sufficiently commensurate with that of the rod to assure that the bracket will retain the rod against movement in the plane of the slot, when the rod is released in the bracket and the bracket resumes the normally relaxed condition thereof.

2. The rod holder according to claim 1 wherein the collar sections and the rim of the infrastructure have a substantially common width on perpendiculars to the sides of the infrastructure, and the body portions of the bracket also form a nip at the opening of the slot in the rim of the infrastructure.

3. The rod holder according to claim 2 wherein the recesses are part cylindrical, so that each pair of clamping sections forms a substantially cylindrical surface when the nips are closed under the bias of the prop means.

4. The rod holder according to claim 1 wherein the prop means include a strut that is obliquely inclined to one of the clamps in the infrastructure of the adjoining body portion of the bracket.

5. The rod holder according to claim 4 wherein the collar sections and the rim of the infrastructure have a substantially common width on perpendiculars to the sides of the infrastructure, the one clamp is spaced apart from one end of the base plate, one end portion of the rim inclines from the level of the opening of the slot, to the level of the one end portion of the base plate, and the strut is interposed between the one end portion of the rim and the one clamp, in the space between the one clamp and the one end of the base plate.

6. The rod holder according to claim 5 wherein the infrastructure of the respective body portion is open from side-to-side thereof, in the space between the strut and the one clamp, as well as in the space between the strut and the one end portion of the rim.

7. The rod holder according to claim 1 wherein the prop means include an open-faced web that is perpendicular to one of the clamps in the infrastructure of the adjoining body portion of the bracket.

8. The rod holder according to claim 7 wherein the web is disposed in a plane central of and parallel to the opposing sides of the infrastructure.

9. The rod holder according to claim 7 wherein the collar sections and the rim of the infrastructure have a substantially common width on perpendiculars to the sides of the infrastructure, the rim extends at the level of the opening of the slot, to the opening of a second slot spaced apart from the one clamp on the rim of the infrastructure, and the web is interposed between the rim and the base plate in the space between the one clamp and the second slot.

10. In a rod holder, a base plate, a bracket of substantially resiliently flexible material, relatively upstanding on the plate at one side thereof, said bracket having a rimmed infrastructure lying between opposing sides thereof, and a plurality of spaced slots in the rim thereof which open to the sides of the infrastructure, said slots having center planes which are perpendicular to the one side of the plate, and walls which depend from the rim to points substantially contiguous to the one side of the plate, so that the body of the bracket is divided into pairs of relatively resiliently displaceable portions having opposing walls on the opposing sides of the planes of the slots, the walls of the respective pairs of body portions having successive pairs of part annular collar sections therein, the recesses of which are opposed to one another across the respective planes of the slots and define successive clamping rings, the diameters of which, in the normally relaxed condition of the bracket, are progressively smaller in the planar directions of the slots relatively toward the one side of the plate, so that the respective pairs of body portions form caduceous-like pairs of clamps which are relatively reciprocable about said points, and have nips between the respective pairs of clamping rings at the respective planes of the slots, and prop means in the respective pairs of body portions for yieldably shoring up the respective pairs of clamps, said prop means being operable to bias the respective pairs of clamps in the direction of closing the nips of the respective slots, but yieldable in the opposing direction to tho planar impalement of a rod in any one of the slots at the rim of the infrastructure, and to depression of the rod through each successive nip thereafter in the respective slot, until a particular clamping ring has a diameter sufficiently commensurate with that of the rod to assure that the bracket will retain the rod against movement in the plane of the slot, when the rod is released in the bracket and the bracket resumes the normally relaxed condition thereof.

11. The rod holder according to claim 10 wherein the bracket is trapezoidal at the opposing sides thereof, and the infrastructure of the bracket has four slots in the rim thereof, and alternate struts and webs in the successive body portins thereof, from one inclined end portion of the rim to the other.

12. The ornamental design for a rod holder, as shown and described.

* * * * *